US009772104B2

(12) United States Patent
Lv et al.

(10) Patent No.: US 9,772,104 B2
(45) Date of Patent: Sep. 26, 2017

(54) LARGE-SIZE CIRCULATING FLUIDIZED BED BOILER, AIR DISTRIBUTOR AND AIR DISTRIBUTOR ASSEMBLY

(71) Applicant: INSTITUTE OF ENGINEERING THERMOPHYSICS, CHINESE ACADEMY OF SCIENCES, Beijing (CN)

(72) Inventors: Qinggang Lv, Beijing (CN); Ming Gao, Beijing (CN); Guoliang Song, Beijing (CN); Xiaofang Wang, Beijing (CN); Yunkai Sun, Beijing (CN); Dongyu Wang, Beijing (CN); Tuo Zhou, Beijing (CN)

(73) Assignee: INSTITUTE OF ENGINEERING THERMOPHYSICS, CHINESE ACADEMY OF SCIENCES, Beijing (CN)

( * ) Notice: Subject to any disclaimer, the term of this patent is extended or adjusted under 35 U.S.C. 154(b) by 312 days.

(21) Appl. No.: 14/412,270

(22) PCT Filed: Dec. 24, 2013

(86) PCT No.: PCT/CN2013/090309
§ 371 (c)(1),
(2) Date: Dec. 31, 2014

(87) PCT Pub. No.: WO2014/101746
PCT Pub. Date: Jul. 3, 2014

(65) Prior Publication Data

US 2015/0184847 A1 Jul. 2, 2015

(30) Foreign Application Priority Data

Dec. 31, 2012 (CN) ..... 2012 1 0591114

(51) Int. Cl.
*F22B 31/00* (2006.01)
*F23C 10/10* (2006.01)
(Continued)

(52) U.S. Cl.
CPC ..... *F23C 10/10* (2013.01); *F22B 31/003* (2013.01); *F22B 31/0061* (2013.01);
(Continued)

(58) Field of Classification Search
CPC ..... F22B 31/003
(Continued)

(56) References Cited

U.S. PATENT DOCUMENTS 1,756,254 A * 4/1930 Lykken ..... B01J 8/24 241/40
2,055,452 A * 9/1936 Gullette ..... C10G 9/20 122/367.1
(Continued)

FOREIGN PATENT DOCUMENTS

CN 1166890 C 9/2004
CN 100575782 C 12/2009
(Continued)

OTHER PUBLICATIONS

Extended European Search Report issued Aug. 2, 2016 in corresponding application No. 13869476.5.
(Continued)

*Primary Examiner* — Avinash Savani
(74) *Attorney, Agent, or Firm* — Browdy and Neimark, PLLC

(57) ABSTRACT

The present invention provides a circulating fluidized bed boiler, comprising: furnace side walls; a ceiling; an air distribution plate provided at a bottom of a furnace; and at least one air distribution cone provided on the air distribution plate, wherein each air distribution cone extends upwards from the air distribution plate into an interior of the furnace and has a shape gradually tapered in an extending direction, cone side walls which form the air distribution cone are provided with secondary air ports, the cone side
(Continued)

walls are separated from the furnace side walls, and a furnace combustion space is formed and surrounded by the ceiling, the furnace side walls, the air distribution plate, and the cone side walls. The present invention further relates to an air distributor for a circulating fluidized bed boiler, the air distributor being provided on an air distribution plate of the boiler, wherein the air distributor is in a form of an air distribution cone, which extends upwards from the air distribution plate into an interior of a furnace to form a shape gradually tapered in an extending direction, and secondary air ports are formed in air distribution cone side walls forming the air distribution cone. The present invention also relates to an air distributor assembly for a circulating fluidized bed boiler.

18 Claims, 7 Drawing Sheets

(51) Int. Cl.
*F23C 10/18* (2006.01)
*F23C 10/20* (2006.01)

(52) U.S. Cl.
CPC ..... *F22B 31/0084* (2013.01); *F23C 10/18* (2013.01); *F23C 10/20* (2013.01)

(58) Field of Classification Search
USPC ..... 431/170
See application file for complete search history.

(56) References Cited

U.S. PATENT DOCUMENTS

| | | | | | |
|---|---|---|---|---|---|
| 2,465,464 | A | * | 3/1949 | Meyer | F02C 3/26 110/165 R |
| 4,545,959 | A | * | 10/1985 | Schilling | B01J 8/34 34/369 |
| 4,589,841 | A | * | 5/1986 | Bergkvist | B01J 8/1818 122/4 D |
| 4,628,834 | A | * | 12/1986 | McKelvie | B01J 8/40 110/165 R |
| 4,702,019 | A | * | 10/1987 | Tsuruno | F27D 15/0286 34/168 |
| 4,864,944 | A | | 9/1989 | Engstrom et al. | |
| 5,215,042 | A | | 6/1993 | Beisswenger et al. | |
| 5,286,188 | A | * | 2/1994 | Barkley | B01J 8/1827 110/243 |
| 5,370,084 | A | | 12/1994 | Skowyra et al. | |
| 5,836,257 | A | | 11/1998 | Belin et al. | |
| 2014/0299027 | A1 | | 10/2014 | Lu et al. | |

FOREIGN PATENT DOCUMENTS

| | | | |
|---|---|---|---|
| CN | 201636837 | U | 11/2010 |
| CN | 101718430 | B | 5/2011 |
| CN | 101818894 | B | 10/2011 |
| CN | 202371705 | U | 8/2012 |
| CN | 102997231 | A | 3/2013 |
| DE | 3027517 | A1 | 2/1982 |
| EP | 0444732 | A1 | 9/1991 |
| WO | 2012103790 | A1 | 8/2012 |

OTHER PUBLICATIONS

Office Action, dated Aug. 9, 2016 in corresponding application No. KR10-2015-7002202.

PCT/CN2013/090309 International Search Report Feb. 28, 2014.

PCT/CN2013/090309 Written Opinion Apr. 3, 2014.

Office Action issued Feb. 19, 2016 in corresponding Korean Patent Application No. 10-2015-7002202, with English translation.

* cited by examiner

LARGE-SIZE CIRCULATING FLUIDIZED BED BOILER, AIR DISTRIBUTOR AND AIR DISTRIBUTOR ASSEMBLY

FIELD OF THE INVENTION

Embodiments of the present invention generally relate to a circulating fluidized bed boiler, and particularly, to a secondary air distributor of a large-size circulating fluidized bed boiler.

DESCRIPTION OF THE RELATED ART

To be large-size and high-parameter is an inevitable trend in the development of a circulating fluidized bed boiler. With increasing of capacity of a boiler, continuous increasing of cross section of a furnace makes it difficult for a secondary air to reach the center of the furnace. Meanwhile, with increasing in steam parameters of the boiler, particularly up to supercritical or ultra-supercritical steam parameters, the increasing of a heat emission volume of the furnace is more quickly than the increasing of an evaporation heating surface in the furnace, and the increased imbalance between the heat emission and the heat absorption adversely affects arrangement of the heating surfaces. Thus, the penetration of the secondary air and the arrangement of the heating surfaces become main technical bottlenecks for the large-sized and the high-parameterized of the circulating fluidized bed boiler.

In order to solve the problem of penetration of the secondary air, a U.S. Pat. No. 5,370,084 discloses a circulating fluidized bed boiler having a furnace formed into a configuration of undershorts legs, wherein a lower portion of the furnace is designed as a undershorts legs-shaped structure, an air distribution plate of the furnace is accordingly divided into two separate parts respectively corresponding to the two undershorts legs whose lower portions are completely separated from each other and whose top portions are communicated with each other; secondary air ports are provided in inner side wall surfaces of the undershorts legs so as to solve the problem of penetration of the secondary air within a bottom dense zone of the furnace; however, since the bottom dense zone of the furnace is divided into two parts, a pressure fluctuation between the two undershorts legs will easily result in occurrence of a bed-overturn phenomenon during practical operation, introducing much hidden trouble to safe and stable operations of the boiler. In order to solve the problem of bed-overturn, a Chinese patent ZL 201010159794.8 discloses a circulating fluidized bed boiler, in which a furnace in the form of undershorts legs is divided longitudinally into two completely symmetrical portions by an intermediate membrane wall, and a vent hole is provided in an upper portion of the intermediate membrane wall to balance pressures on both sides thereof, thereby restraining occurrence of bed-overturn.

On basis of the furnace formed into the configuration of undershorts legs, in order to solve the problem of the arrangement of the heating surfaces, a Chinese patent 201020147895.9 discloses an intermediate partition water wall for a furnace of a circulating fluidized bed boiler, wherein an intermediate-partition-water-wall panel is provided at a top portion of the undershorts legs so as to increase evaporation heating surface area of the furnace; for a circulating fluidized bed boiler with a large capacity and high parameters, the height of this intermediate-partition-water-wall panel is increased as the height of the furnace is increased, resulting in that a strength thereof is difficult to be ensured, and deformation and vibration of the panel cannot be avoided.

SUMMARY OF THE INVENTION

In order to solve at least one aspect of the above problems, the present invention is made.

According to one exemplary aspect of the present invention, there is provided a circulating fluidized bed boiler, comprising: furnace side walls; a ceiling; an air distribution plate provided at a bottom of a furnace; and at least one air distribution cone provided on the air distribution plate, wherein: each air distribution cone extends upwards from the air distribution plate into an interior of the furnace and has a shape gradually tapered in an extending direction, cone side walls which form the air distribution cone are provided with secondary air ports, the cone side walls are separated from the furnace side walls, and a furnace combustion space is formed and surrounded by the ceiling, the furnace side walls, the air distribution plate, and the cone side walls.

In the circulating fluidized bed boiler, optionally, for each air distribution cone: the air distribution cone comprises two first inclined cone side walls arranged to oppose to each other and two vertical cone side walls arranged to oppose to each other; the two first inclined cone side walls are jointed or met at a top end of the air distribution cone and are connected with the two vertical cone side walls, and an arris line formed by the two jointed or met first inclined cone side walls is substantially parallel to the air distribution plate; and the secondary air ports are provided in the two first inclined cone side walls respectively.

Further, the cone side walls are consisted of membrane walls; and a first header is formed at the arris line so as to be parallel to the air distribution plate, the two first inclined cone side walls are collected into the first header, and a first membrane panel extends upwards and vertically from the first header. Optionally, the first membrane panel is arranged over the whole length of the first header in a length direction thereof. Optionally, the first membrane panel comprises two first heating panel portions arranged adjacent to two ends of the first header, the two first heating panel portions are spaced apart from each other in a length direction of the first header. Preferably, the two vertical cone side walls extend upwards and vertically to form second membrane panels. Further preferably, each of the second vertical cone side walls is collected into a second header, the second header is perpendicular to the first header and is provided at a position having the same height as that of the first header. The first header and the second header may be communicated with each other. Optionally, each of the second vertical cone side walls is collected into a second header, the second header is perpendicular to first header and is provided at a position having a different height from that of the first header.

Or optionally, the cone side walls are consisted of membrane walls; and the two first inclined cone side walls are collected into a tee pipe at the arris line and communicate with two branches of the tee pipe respectively, and a third branch of the tee pipe extends upwards and vertically to form a first membrane panel.

Or optionally, the cone side walls are consisted of membrane walls; the two first inclined cone side walls are jointed at the arris line, then extend upwards and vertically and are parallel with each other so as to form a first membrane panel, which is a double-layer panel.

Preferably, each of the two vertical cone side walls extend upwards and vertically to form a second membrane panel.

Preferably, a T-shaped extended heating panel is formed by the first membrane panel and the second membrane panel at an end of the arris line formed by the two jointed or met first inclined cone side walls, wherein the first membrane panel composes the vertical of the T shape, while the second membrane panel composes a the horizontal of the T shape, and the first membrane panel and the second membrane panel are welded together by fins.

In the circulating fluidized bed boiler, optionally, for each air distribution cone: the air distribution cone comprises two first inclined cone side walls arranged to oppose to each other and two second inclined cone side walls arranged to oppose to each other, the two first inclined cone side walls are jointed or met at a top end of the air distribution cone and are connected with the two second inclined cone side walls, and an arris line formed by the two jointed or met first inclined cone side walls is substantially parallel to the air distribution plate; and the secondary air ports are provided in the two first inclined cone side walls respectively.

Preferably, the secondary air ports are further provided in the two second inclined cone side walls.

Further, the cone side walls are consisted of membrane walls; and a first header is formed at the arris line so as to be parallel to the air distribution plate, the two first inclined cone side walls are collected into the first header, and a first membrane panel extends upwards and vertically from the first header. Further, the first membrane panel is arranged over the whole length of the first header in a length direction thereof the first header length direction. Optionally, the first membrane panel comprises two first heating panel portions arranged adjacent to two ends of the first header, and the two first heating panel portions are spaced apart from each other in a length direction of the first header.

Preferably, the two second inclined cone side walls are jointed with the two first inclined cone side walls respectively so that arris lines are formed at joints, a second header is provided above each of the arris lines formed at joints, membrane walls of the two second inclined cone side walls are collected into the second headers, and a respective second membrane panel extends upwards and vertically from the respective second header. Further, each second header is horizontally provided at a position having the same height as that of the first header.

Or optionally, the cone side walls are consisted of membrane walls; and the two first inclined cone side walls are collected into a tee pipe at the arris line and communicate with two branches of the tee pipe respectively, and a third branch of the tee pipe extends upwards and vertically to form a first membrane panel.

Or optionally, the cone side walls are consisted of membrane walls; the two first inclined cone side walls are jointed at the arris line, then extend upwards and vertically and are parallel with each other so as to form a first membrane panel, which is a double-layer panel.

Preferably, the two second inclined cone side walls are jointed with the first inclined cone side walls, then extend upwards and vertically and are parallel with each other so as to form second membrane panels.

Preferably, a Y-shaped extended heating panel is formed by the first membrane panel and the second membrane panel at an end of the arris line formed by the two jointed or met first inclined cone side walls, wherein the first membrane panel composes the vertical of the Y shape, while the second membrane panel composes a V-shaped portion of the Y shape, and the first membrane panel and the second membrane panel are welded together by fins.

Preferably, additional secondary air ports are provided in the furnace side walls.

Preferably, the air distribution cone comprises a lower portion adjacent to the air distribution plate and an upper portion away from the air distribution plate, wherein the lower portion extends upwards and vertically from the air distribution plate, and the upper portion extends upwards to be tapered from a joint with the lower portion.

Optionally, a section of the air distribution cone parallel to the air distribution plate is formed into an oblong shape or a polygon shape having more than 4 sides.

Preferably, a space, which is not a part of the furnace combustion space and is in communication with an external environment of the furnace, is provided below the cone side walls, for arranging secondary air pipes therein.

Preferably, an arrangement of the air distribution cones is symmetrical with respect to a first furnace bisecting section perpendicular to front and rear walls of the furnace. Further, the arrangement of the air distribution cones is symmetrical with respect to a furnace bisecting section perpendicular to right and left walls of the furnace. Preferably, each of the first inclined cone side walls is arranged to be substantially perpendicular to the front and rear walls of the furnace. Further, the air distribution plate is provided with a plurality of the air distribution cones which are spaced apart from each other. Preferably, all of the air distribution cones have the same size and configuration.

Preferably, the boiler further comprises one or more furnace top headers provided above the ceiling, wherein the membrane panels which extend upwards and vertically pass through the ceiling are collected into the respective furnace top headers.

Preferably, surfaces of the cone side walls facing towards the furnace combustion space are coated with refractory materials.

According to another exemplary aspect of the present invention, there is provided an air distributor for a circulating fluidized bed boiler, the air distributor being provided on an air distribution plate of the boiler, wherein: the air distributor is in a form of an air distribution cone, which extends upwards from the air distribution plate into an interior of a furnace to form a shape gradually tapered in an extending direction, and secondary air ports are formed in air distribution cone side walls forming the air distribution cone. Preferably, a space, which is not a part of the furnace combustion space and is in communication with an external environment of the furnace, is provided below the cone side walls, for arranging secondary air pipes therein. Preferably, the air distribution cone comprises two inclined cone side walls, which are arranged to oppose to each other, and are jointed or met at a top end of the air distribution cone to form an arris line which is substantially parallel to the air distribution plate; and secondary air ports are provided in the two inclined cone side walls respectively. Preferably, the cone side walls are consisted of membrane wall.

According to a further exemplary aspect of the present invention, there is provided an air distributor assembly for a circulating fluidized bed boiler, comprising: the air distributor as described above; and a membrane panel extending upwards from the air distribution cone to form into an expanded heating surface, the membrane panel being in fluid communication with the membrane wall of a respective air distribution cone side wall.

One or more air distribution cones are provided in a bottom of the furnace and the air distribution plate is formed into a shape whose portions are communicated with each other, such as 凵, 日 or 目, so that materials and gases in dense zone at bottom of the furnace and the dilute zone can freely circulate, thereby solving the problem of bed-overturn due to unbalanced pressure inside the two separate under-shorts legs in prior arts; the air distribution cone provides a space for arranging the secondary air to be injected from the dense zone of the furnace into the furnace, thereby solving the problem of penetration of the secondary air; meanwhile, by providing a T or Y shaped extended heating panel at top of the air distribution cone, not only the heating surface area inside the furnace is increased, but also the rigidity of the panel is increased, thereby greatly reducing vibration and deformation of the panel so as to decrease the risk of tube burst associated therewith.

Compared to prior arts, in the large-size circulating fluidized bed boiler of the present invention, good flow uniformity is achieved in the dense zone of the furnace, the hidden trouble of bed-overturn is eliminated, the secondary air can reach the center of the furnace, thereby facilitating ensuring combustion efficiency and controlling combustion atmosphere; by providing a T or Y shaped extended heating panel at top of the air distribution cone, the heating surface area inside the furnace is increased, the rigidity of the panel is increased, vibration and deformation of the panel are small, thereby enhancing operation safety of the boiler.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
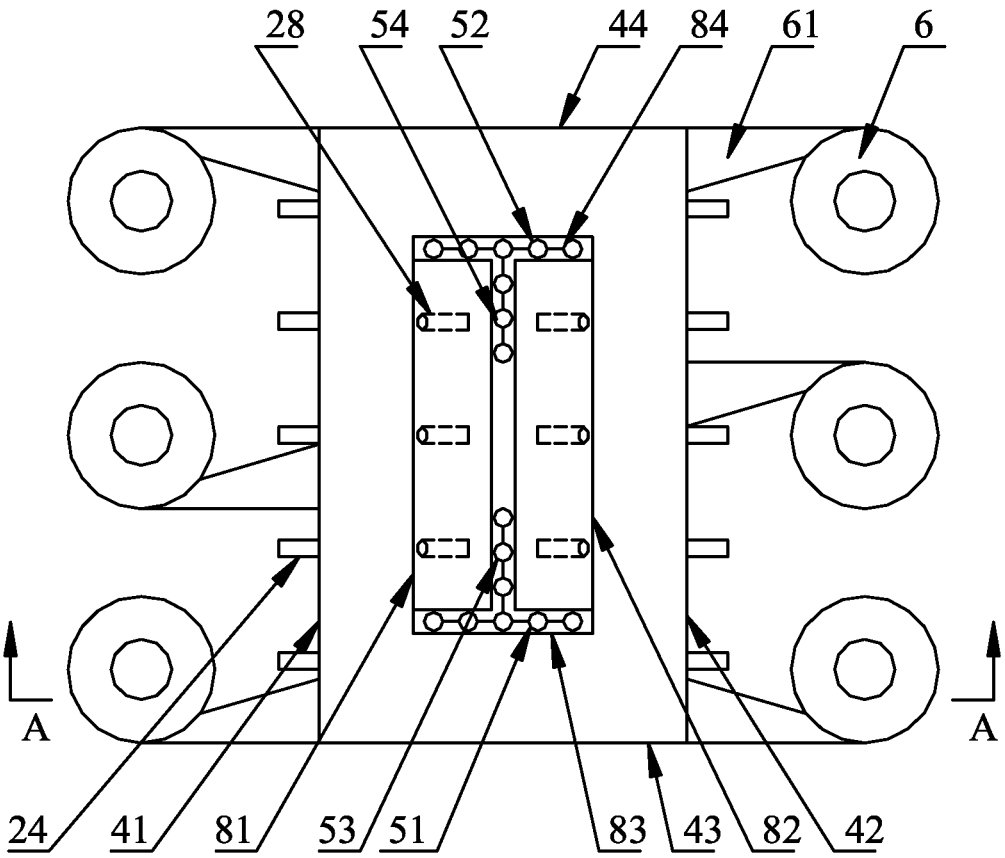
FIG. 1 is a schematic top view of a furnace of a large-size circulating fluidized bed boiler according to a first embodiment of the present invention.

Exemplary embodiments of the present invention will be described hereinafter in detail with reference to the attached drawings, wherein the like reference numerals refer to the like elements. The embodiments described with respect to the drawings are only for illustration rather than for limitation.

A circulating fluidized bed boiler having air distribution cones will be described below with reference to FIGS. 1-9.

Figure 6:
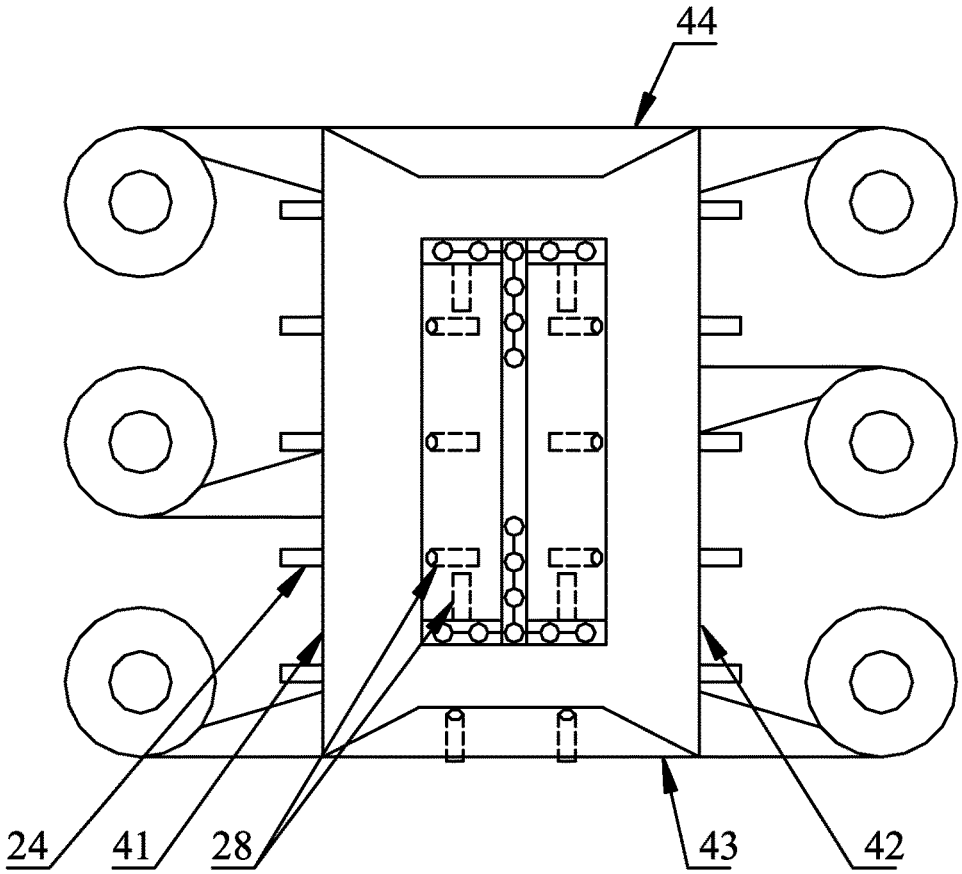
FIG. 6 is a schematic top view of a furnace of another large-size circulating fluidized bed boiler according to the first embodiment of the present invention.
Figure 7:
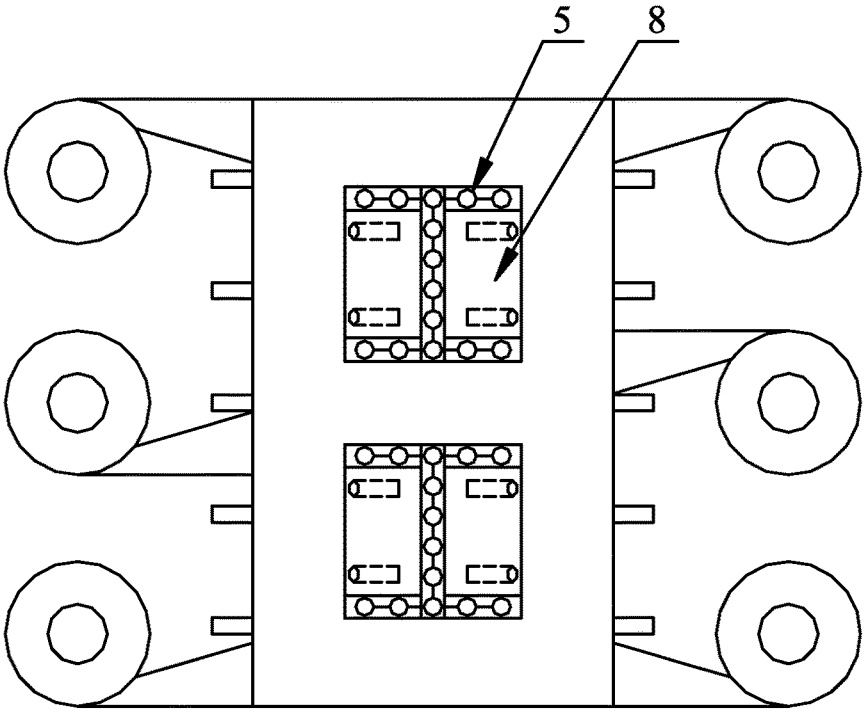
FIG. 7 is a schematic front view of a furnace of a further large-size circulating fluidized bed boiler according to the first embodiment of the present invention.
Figure 8:
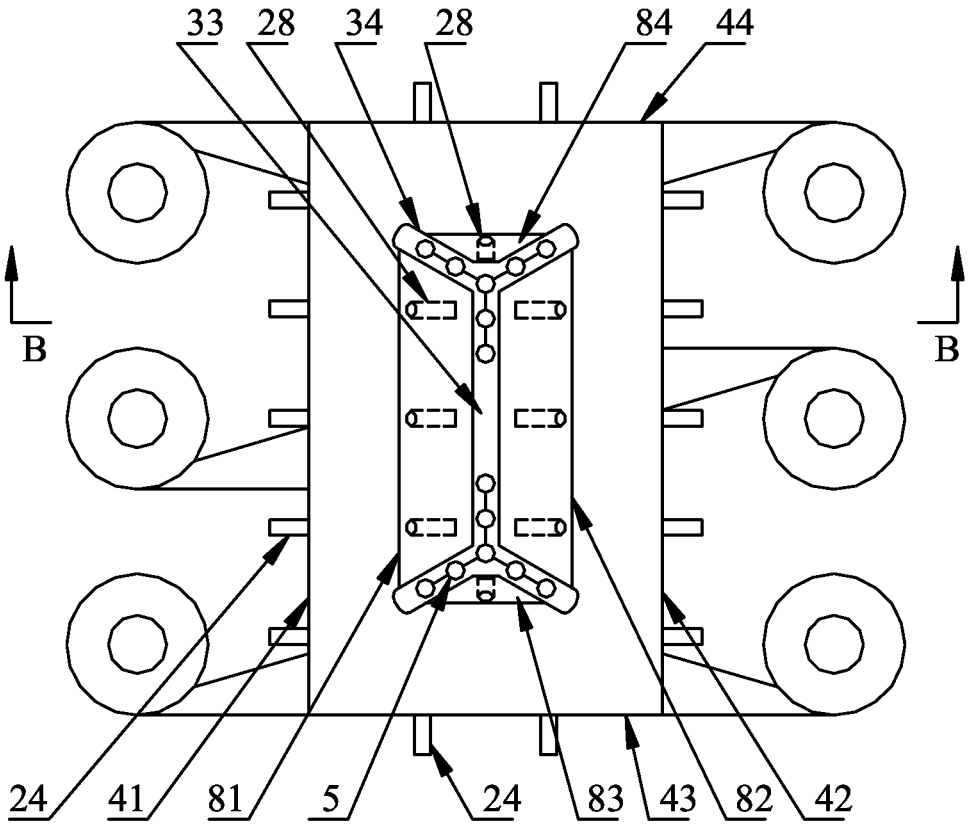
FIG. 8 is a schematic top view of a furnace of another large-size circulating fluidized bed boiler according to a second embodiment of the present invention.

As shown in FIGS. 1-3, 6-9, a circulating fluidized bed boiler comprises: furnace side walls 41-44; a ceiling 45; an air distribution plate 11 provided at a bottom of a furnace; and at least one air distribution cone 8 provided on the air distribution plate, wherein: each air distribution cone 8 extends upwards from the air distribution plate 11 into an interior of the furnace and has a shape gradually tapered in an extending direction, cone side walls 81-84 which form the air distribution cone 8 are provided with secondary air ports 28 (side walls 81, 82 are provided with secondary air ports 28 in FIG. 1, while all side walls 81-84 are provided with secondary air ports 28 in FIG. 8), the cone side walls are separated from the furnace side walls 41-44, and a furnace combustion space is formed and surrounded by the ceiling 45, the furnace side walls 41-44, the air distribution plate 11, and the air distribution cones side walls 81-84.

Some or all of the air distribution cones taper inwardly (that is, wall faces are inclined towards a center of a projection of a bottom face of the air distribution cone) while extending upwards, so that the cross sectional area of the lower portion of the furnace is increased continuously as the height of the lower portion of the furnace is increased, until to be substantially the same as that of the upper portion of the furnace where no air distribution cone is provided.

Since the air distribution cone 8 extends upwards from the air distribution plate into interior of the furnace, and the secondary air ports 28 are provided in the cone side walls, the secondary air can be arranged to be injected from the center of the dense zone of the furnace into the furnace, and the penetration capacity of the secondary air is improved.

With reference to FIGS. 1-3 and 6-7, for each air distribution cone 8: the air distribution cone 8 comprises two first inclined cone side walls 81, 82 arranged to oppose to each other and two vertical cone side walls 83, 84 arranged to oppose to each other; the two first inclined cone side walls 81, 82 are jointed or met at a top end of the air distribution cone 8 and are connected with the two vertical cone side walls 83, 84, and an arris line formed by the two jointed or met first inclined cone side walls is substantially parallel to the air distribution plate 11; the secondary air ports 24 are provided in the two first inclined cone side walls 81, 82 respectively.

Preferably, the cone side walls 81-84 are consisted of membrane walls; and a first header 31 (see FIGS. 2 and 3) is formed at the arris line so as to be parallel to the air distribution plate 11, the two first inclined cone side walls 81, 82 are collected into the first header 31 (see FIG. 2), and first membrane panels 53, 54 extend upwards and vertically from the first header 31. The first membrane panels are extended heating panels. The first membrane panels may be arranged over the whole length of the first header in a length direction thereof. Optionally, the first membrane panel comprises two first heating panel portions arranged adjacent to two ends of the first header, the two first heating panel portions are spaced apart from each other in a length direction of the first header.

The extended heating panel may only include the first membrane panel, for example, the other two side walls 83, 84 of the air distribution cone 8 are heat insulated rather than being membrane walls. However, when other two side walls 83, 84 of the air distribution cone 8 are membrane walls, other extended heating panels may be provided. Specifically, the two vertical cone side walls 83, 84 extend upwards and vertically to form second membrane panels 51, 52.

Figure 2:
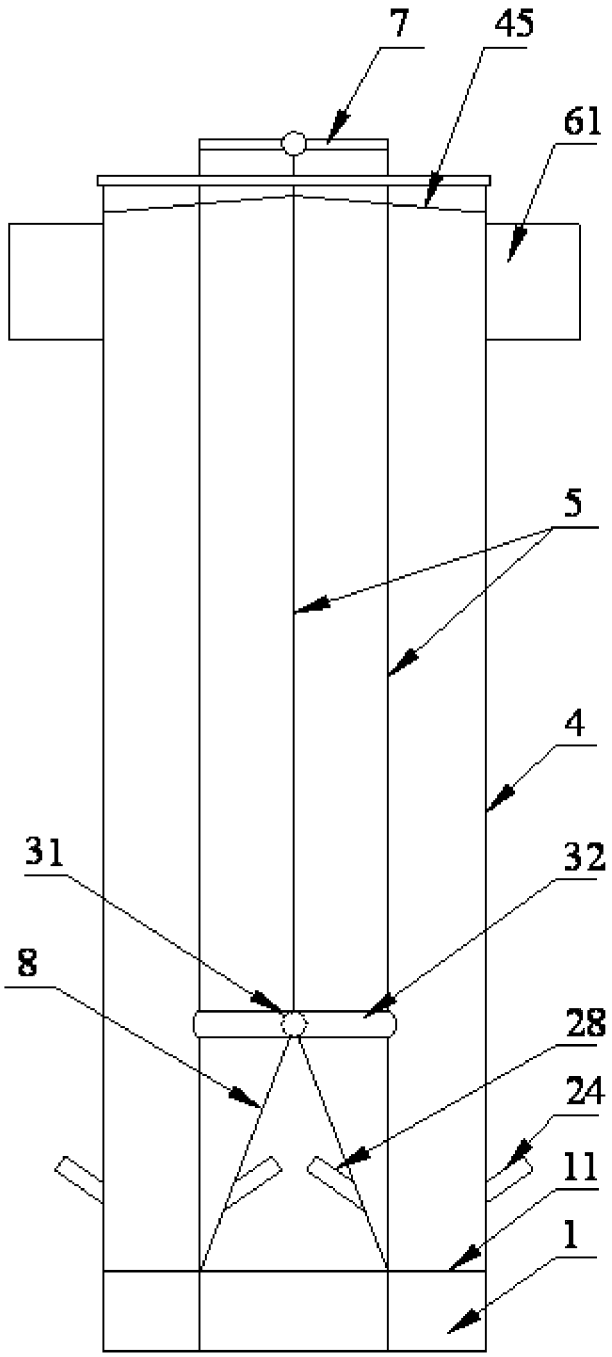
FIG. 2 is a schematic cross-sectional view of the furnace of the large-size circulating fluidized bed boiler according to the first embodiment of the present invention, taken along a line A-A shown in FIG. 1.

As shown in FIGS. 1-2, the second vertical cone side walls 83, 84 are collected into a second header 32, the second header 32 is perpendicular to the first header 31 and is provided at a position having the same height as that of the first header. Preferably, the first header 31 and the second header 32 are communicated with each other, that is, form into an I shape. Optionally, the second vertical cone side walls are collected into a second header, the second header is perpendicular to first header and is provided at a position having a different height from that of the first header.

Figure 3:
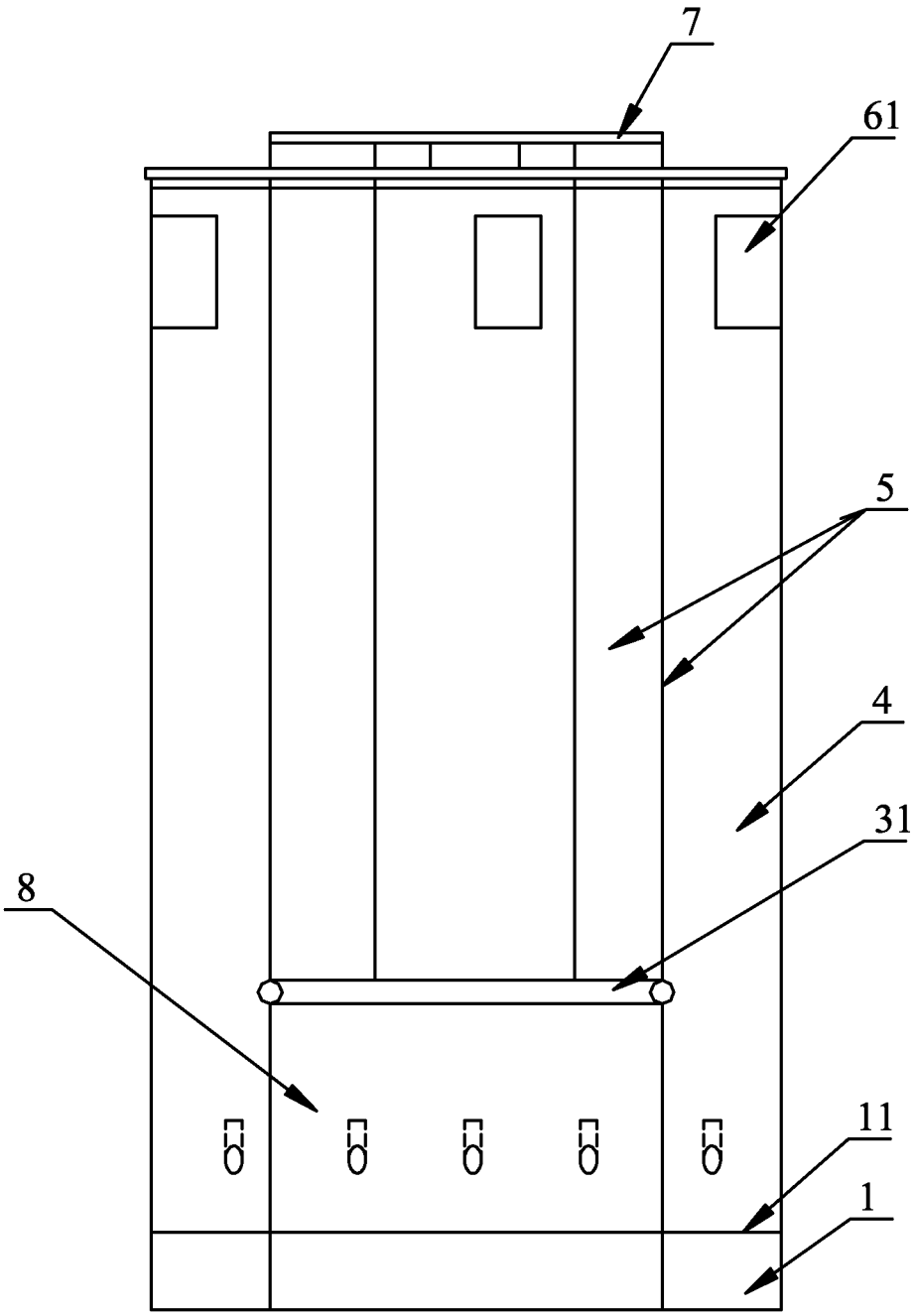
FIG. 3 is a schematic side view of the furnace of the large-size circulating fluidized bed boiler according to the first embodiment of the present invention.
Figure 4:
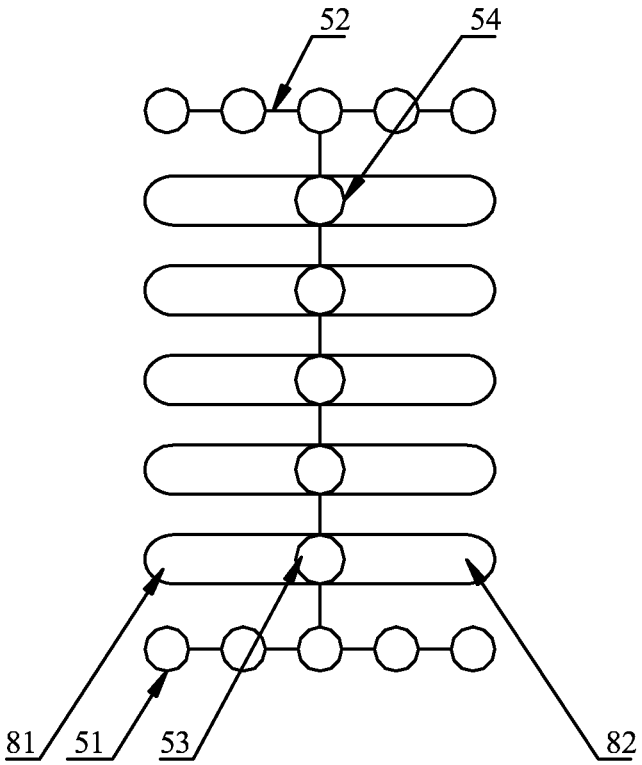
FIG. 4 is a schematic top view of an extended heating panel and an air distribution cone according to the first embodiment of the present invention.

As a variant of the example shown in FIGS. 1-3, the cone side walls are consisted of membrane walls; and the two first inclined cone side walls are collected into a tee pipe at the arris line and communicate with two branches of the tee pipe respectively, and a third branch of the tee pipe extends upwards and vertically to form a first membrane panel. This arrangement is shown in FIG. 4.

Figure 5:
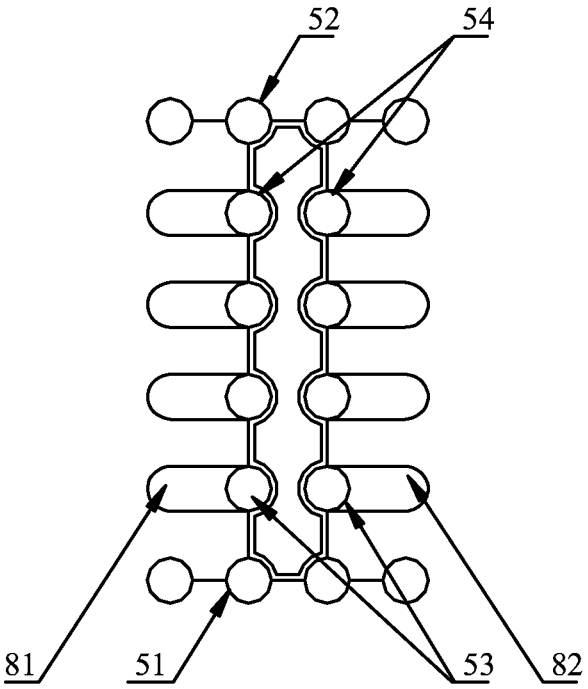
FIG. 5 is a schematic top view of another extended heating panel and another air distribution cone according to the first embodiment of the present invention.

As a variant of the example shown in FIGS. 1-3, the cone side walls are consisted of membrane walls; the two first inclined cone side walls are jointed at the arris line, then extend upwards and vertically and are parallel with each other so as to form a first membrane panel, which is a double-layer panel. The two vertical cone side walls may also extend upwards and vertically to form a second membrane panel. This arrangement is shown in FIG. 5.

Preferably, a T-shaped expansion heating surface (for example, as shown in FIG. 1) is formed by the first membrane panels 53, 54 and the second membrane panels 51, 52 at an end of the arris line formed by the two jointed or met first inclined cone side walls, the first membrane panel composes the vertical of the T shape, while the second membrane panel composes a the horizontal of the T shape. The first membrane panel and the second membrane panel may be welded together by fins.

A pair of side walls of the cone side walls 81,82 is described above to extend vertically. The case in which the cone side walls 81-84 are inclined will be described below with reference to FIGS. 8 and 9.

Figure 9:
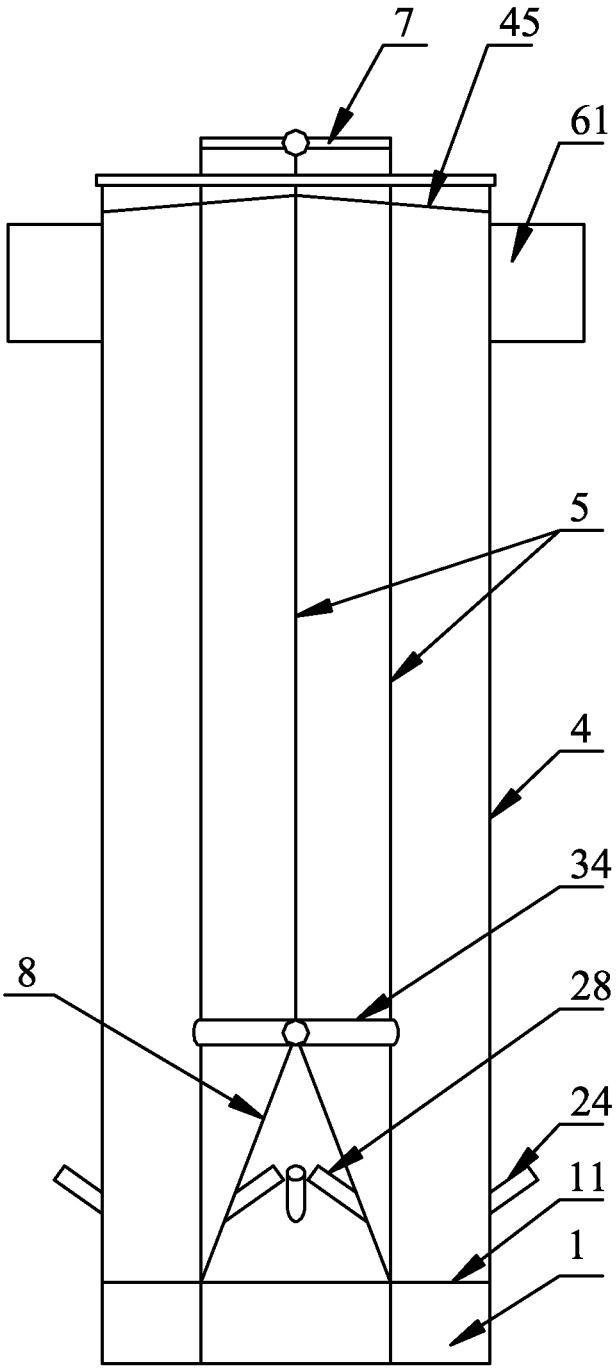
FIG. 9 is a schematic cross-sectional view of the furnace of the large-size circulating fluidized bed boiler according to the second embodiment of the present invention, taken along a line B-B shown in FIG. 8.

As shown in FIGS. 8-9, for each air distribution cone 8: the air distribution cone 8 comprises two first inclined cone side walls 81, 82 arranged to oppose to each other and two second inclined cone side walls 83, 84 arranged to oppose to each other, the two first inclined cone side walls 81, 82 are jointed or met at a top end of the air distribution cone and are connected with the two second inclined cone side walls 83, 84, and an arris line formed by the two jointed or met first inclined cone side walls 81, 82 is substantially parallel to the air distribution plate 11; and the secondary air ports 28 are provided in the two first inclined cone side walls 81, 82 respectively. The secondary air ports 28 may also be provided in the two second inclined cone side walls 83, 84 respectively.

As shown in FIGS. 8, 9, the cone side walls 81-84 are consisted of membrane walls; and a first header 33 is formed at the arris line so as to be parallel to the air distribution plate 11, the two first inclined cone side walls 81, 82 are collected into the first header 33, and a first membrane panels 52, 54 extend upwards and vertically from the first header 33. Similarly, the first membrane panels 53, 54 are extended heating panels. The first membrane panels may be arranged over the whole length of the first header in a length direction thereof. Optionally, the first membrane panel comprises two first heating panel portions arranged adjacent to two ends of the first header, the two first heating panel portions are spaced from each other in a length direction of the first header.

As shown in FIG. 8-9, the two second inclined cone side walls 83, 84 are jointed with the two first inclined cone side walls 81, 82 respectively so that arris lines are formed at joints, a second header 34 is provided above each of the arris lines, membrane walls of the two second inclined cone side walls are collected into the second headers 34, and respective second membrane panels 51, 52 extend upwards and vertically from the second headers 34. Optionally, each second header is provided at a position having the same height as that of the first header and is communicated with the first header.

As a variant of the example shown in FIGS. 8 and 9, the cone side walls are consisted of membrane walls; and the two first inclined cone side walls are collected into a tee pipe at the arris line and communicate with two branches of the tee pipe respectively, and a third branch of the tee pipe extends upwards and vertically to form a first membrane panel.

As a variant of the example shown in FIGS. 8 and 9, the cone side walls are consisted of membrane walls; the two first inclined cone side walls are jointed at the arris line, then extend upwards and vertically and are parallel with each other so as to form a first membrane panel, which is a double-layer panel.

Preferably, as a variant of the example shown in FIGS. 8 and 9, the two second inclined cone side walls are jointed with the first inclined cone side walls, then extend upwards and vertically so as to form second membrane panels 51, 52.

As shown in FIG. 8, a Y-shaped expansion heating surface is formed by the first membrane panel and the second membrane panel at an end of the arris line formed by the two jointed or met first inclined cone side walls, the first membrane panel composes the vertical of the Y shape, while the second membrane panel composes a V-shaped portion of the Y shape. The first membrane panel and the second membrane panel may be welded together by fins.

As shown in FIGS. 1-3 and 6-8, additional secondary air ports 24 may be provided in the furnace side walls.

Although no shown, optionally, the air distribution cone comprises a lower portion adjacent to the air distribution plate and an upper portion away from the air distribution plate, wherein the lower portion extends upwards and vertically from the air distribution plate, and the upper portion extends upwards to be tapered from a joint with the lower portion.

In the above example, description is made by taking the air distribution cone which is generally a rectangular pyramid as an example. However, the shape of the air distribution cone is not limited to this. For example, a section of the air distribution cone parallel to air distribution plate may be formed into an oblong shape or a polygon shape having more than 4 sides.

By providing a T or Y shaped extended heating panel at top of the air distribution cone, not only the heating surface area inside the furnace is increased, but also the rigidity of the panel is increased, thereby greatly reducing vibration and deformation of the panel so as to decrease the risk of tube burst associated therewith, and improving operation safety of the boiler.

Although no shown, preferably, a space, which is not a part of the furnace combustion space and is in communication with an external environment of the furnace, is provided below the cone side walls, for arranging secondary air pipes therein.

Preferably, the air distribution cones are arranged symmetrically within the furnace. For example, the arrangement of the air distribution cones is symmetrical with respect to a first furnace bisecting section perpendicular to front and rear walls 43, 44 of the furnace. Moreover, the arrangement of the air distribution cones is symmetrical with respect to a furnace bisecting section perpendicular to right and left walls of the furnace. Optionally, each of the first inclined cone side walls is arranged to be substantially perpendicular to the front and rear walls of the furnace. Moreover, the air distribution plate is provided with a plurality of the air distribution cones which are spaced apart from each other. Preferably, all of the air distribution cones have the same size and configuration, which is shown in FIG. 7, for example. In the large-size circulating fluidized bed boiler as described above, good flow uniformity is achieved in the dense zone of the furnace, and the hidden trouble of bed-overturn is eliminated.

As shown in FIGS. 2, 3 and 9, one or more furnace top headers 7 are provided above the ceiling, wherein the membrane panels which extend upwards and vertically pass through the ceiling 45 to be collected into the respective furnace top headers.

The present invention further provides an air distributor for a circulating fluidized bed boiler, the air distributor being provided on an air distribution plate of the boiler, wherein: the air distributor is in a form of an air distribution cone, which extends upwards from the air distribution plate into an interior of a furnace to form a shape gradually tapered in an extending direction, and secondary air ports are formed in air distribution cone side walls forming the air distribution cone. Preferably, a space, which is not a part of the furnace combustion space and is in communication with an external environment of the furnace, is provided below the cone side walls, for arranging secondary air pipes therein. Preferably, the air distribution cone comprises two inclined cone side walls, which are arranged to oppose to each other, and are jointed or met at a top end of the air distribution cone to form an arris line which is substantially parallel to the air distribution plate; and secondary air ports are provided in the two inclined cone side walls respectively. Preferably, the cone side walls are consisted of membrane walls.

The present invention further relates to an air distributor assembly for a circulating fluidized bed boiler, comprising: the air distributor as described above; and a membrane panel extending upwards from the air distribution cone to form into an expanded heating surface, the membrane panel being in fluid communication with the membrane wall of a respective air distribution cone side wall.

There may be a single air distribution cone 8, and thus the air distribution plate is in the shape of 凵, as shown in FIGS. 1, 6 and 8; there may also be two or more air distribution cones 8, and thus the air distribution plate is in the shape of 凵 or 日, as shown in FIG. 7; as such, the lower dense zone of the furnace is a continuously communicated zone, thereby ensuring uniformity of flow of materials and gases in the furnace, and avoiding the risk of bed-overturn due to division of the lower portion of the furnace into two separate undershorts legs.

The extended heating panel is provided at top of the air distribution cone, and has a cross section shape dependent on the shape of the air distribution cone, such as a T shape or a Y shape. When only two opposed side walls of the air distribution cone are inclined, the cross section of the extended heating panel is formed into a T shape; when two pairs of opposed side walls of the air distribution cone are inclined, the cross section of the extended heating panel is formed into a Y shape.

Membrane walls of a pair of opposed inclined side walls of the air distribution cone are joined to an arris line at the top of the air distribution cone, and a panel extends from the arris line to the top of the furnace to constitute the vertical of the T or Y shaped extended heating panel. Specifically, a horizontal header may be provided at the arris line, membrane wall pipes of the pair of opposed inclined side walls of the air distribution cone are collected into the horizontal header, and a panel extends upwards from the horizontal header. The panel may have a width equal to a length of the header, or may extend from portions of the header adjacent two ends thereof, no panel extend from a middle portion of the header, so that a flow space is left to communicate two side of the panel; or, the membrane wall pipes of the pair of opposed inclined side walls of the air distribution cone are collected into a tee pipe, one branch of which is a panel extending upwards; as an alternative, the membrane wall pipes of the pair of opposed inclined side walls of the air distribution cone may extend upwards in parallel at the arris line to form a double-layer panel, two layers of which may be secured to each other by a comb plate, and refractory material is filled between the layers. The width of the panel formed in the later two cases is generally equal to the length of the arris line at the top of the air distribution cone.

When the other pair of side walls of the air distribution cone are vertical, their membrane wall pipes extend towards the top of the furnace to form a panel which constitutes the horizontal of a T shape of a T-shaped extended heating panel; the panel is welded to a panel which constitutes the vertical of the T shape of the T-shaped extended heating panel by fins, and pipes of the panels at joint may be designed as large diameter, thick wall pipes to increase strength. The membrane wall pipes of the side walls, when extending upwards, may firstly be collected into a horizontal header, and then a panel may be extended from the horizontal header. With the headers, it is helpful to select optimum design parameters such as pipe diameters, pipe pitches or the like for the membrane wall pipes of the side walls of the air distribution cone and the panel.

When the other pair of side walls of the air distribution cone are inclined, they taper inwardly while extending upwards, and their membrane wall pipes form four arris lines together with side walls of adjacent air distribution cones. In a way similar to those as described above, the header, the tee pipe, the double-layer panel or the like may form a V-shaped panel of a Y shape of a Y-shaped extended heating panel; wherein if a Y-shaped header, and preferably, a horizontal header is used, it is helpful in extending the V-shaped panel from positions having the same height, thereby achieving a more uniform hydrodynamic distribution characteristic. The V-shaped panel is welded to a panel constituting the vertical of the Y shape of the Y-shape extended heating panel.

Embodiments of the present invention will be further described with reference to the accompanying drawings.

First Embodiment

As shown in FIGS. 1 to 3, a circulating fluidized bed boiler is consisted of a furnace 4 with a air chamber 1 at bottom thereof, cyclone separators 6 with cyclone separator inlet pipes 61, a material returner (not shown in figures) and a backpass (not shown in figures); six cyclone separators 6 are arranged outside of a left side wall 41 and a right side wall 42 of the furnace, an air distribution cone 8, which is rectangular in cross section, is provided on an air distribution plate 11 at the bottom of the furnace 4, so that the air distribution plate 11 of the furnace presents a ⊔ shape.

Side walls of the air distribution cone 8 are formed by four membrane water walls coated with refractory materials and surround a hollow space with a bottom opened to atmosphere. As for four side walls of the air distribution cone 8, two side walls 81, 82 opposite to the left and right side wall 41, 42 of the furnace are inclined towards a center of a projection region of a bottom face of the air distribution cone, and are provided with one or two layers of secondary air ports 28 therein; the other side walls of the air distribution cone opposite to front and rear walls 43, 44 of the furnace are vertically arranged. The secondary air ports 28 are in communication with secondary air secondary air pipes extending below the air distribution cone 8. One or two layers of secondary air ports 24 are also provided in the two side walls 41, 42 of the furnace, and have the same height as the secondary air ports 28 in the air distribution cone.

Two inwardly inclined side walls 81, 82 of the air distribution cone 8 are jointed at the top of the air distribution cone 8 to form an arris line parallel to the air distribution plate 11, a transverse header 31 is provided at the arris line, water wall pipes of the side walls 81, 82 are collected into the header 31, and two panels 53, 54 extend upwards from the header 31 and are arranged adjacent to two ends of the header 31 respectively; water wall pipes of the other vertical side wall 83, 84 of the air distribution cone 8 extend upwards and are collected into a horizontal header 32 at the same height as the header 31 (the header 31 is in communication with the header 32 and thus an I-shaped header is formed), to form a panel 51 and a panel 52; the panel 51 and the panel 52 are arranged to form T shapes together with the panels 53, 54 respectively, and thus form two extended heating panels 5 having a T shape in cross section. The panel 53 is not connected with the panel 54, with a space therebetween for communicating two sides of the panels, so that materials and gases can freely circulate within the furnace (the header 31 may also be not communicated with the header 32, and there is a slight different in their heights for their arrangement.)

The extended heating panel 5 extends from the top of the air distribution cone 8 in a height direction of the furnace to the ceiling 45 of the furnace, through the ceiling 45 and is collected into a header 7 at the top of the furnace.

No header may be provided at the top of the air distribution cone 8, and water wall pipes of the side walls 81, 82 of the air distribution cone 8 may extend upwards and directly as a tee pipe or double-layer panel so as to form the panels 53, 54; in such a case, the panels 53, 54 are connected together without any space therebetween, so that the T-shaped extended heating panels are connected together to form an I-shaped extended heating panel. The extended heating panel in the form of tee pipe is shown in the top view of FIG. 4, while the extended heating panel in the form of double-layer panel is shown in the top view of FIG. 5.

When lower portions of the front and rear walls 43 and 44 of the furnace are arranged to be inclined, the two vertical side walls of the air distribution cone 8 may also be provided with secondary air ports, as shown in FIG. 6.

The side walls of the air distribution cone 8 may also be consisted of air-cooled membrane walls, and the extended heating panel 5 is thus an air-cooled panel.

FIG. 7 shows a case in which two air distribution cones 8 are provided at the bottom of the furnace 4. In such a case, the air distribution plate of the furnace presents a 目 shape, and two T-shaped extended heating panels 5 are integrally connected and provided at the top of air distribution cone 8.

Second Embodiment

As shown in FIG. 8, a circulating fluidized bed boiler is consisted of a furnace 4 with a air chamber 1 at bottom thereof, cyclone separators 6 with cyclone separator inlet pipes 61, a material returner (not shown in figures) and a backpass (not shown in figures); six cyclone separators 6 are arranged outside of a left side wall 41 and a right side wall 42 of the furnace, an air distribution cone 8 is provided on an air distribution plate 11 at the bottom of the furnace 4, so that the air distribution plate 11 of the furnace presents a ⊔ shape.

Side walls of the air distribution cone 8 are formed by four membrane water walls coated with refractory materials and surround a hollow space with a bottom opened to atmosphere. As for four side walls of the air distribution cone 8, two side walls 81, 82 opposite to the left and right side wall 41, 42 of the furnace are inclined towards a center of a projection region of a bottom face of the air distribution cone, and form an arris line at the top of the air distribution cone 8, which is parallel to the air distribution plate 11, and a horizontal header 33 is provided at the arris line; the other two side walls are also inclined towards the center of the projection region of the bottom face of the air distribution cone, and are crossed with the side walls 81, 82 of the air distribution cone, so that four arris lines are formed with angles relative to the air distribution plate 11.

Horizontal headers 34 are respectively above the four arris lines at positions having the same height as the header 33. The header 33 and the headers 34 may be separated, or communicated with each other to form a Y-shaped header.

Water wall pipes at middle portions of the side walls 81, 82 of the air distribution cone are collected into the header 33, water wall pipes adjacent to two ends of the side walls 81, 82 of the air distribution cone and water wall pipes of the side walls 83, 84 of the air distribution cone are bent at the four arris lines, extend upwards and are collected into the headers 34. Y-shaped extended heating panels 5 extend from the headers 33, 34 to the ceiling 45 of the furnace, through the ceiling 45 and are collected into the header 7 at the top of the furnace.

All of the side walls 81, 82, 83 and 84 of the air distribution cone may be provided with secondary air ports 28 therein, which are in communication with secondary air secondary air pipes extending below the air distribution cone 8. The two side walls 41, 42 and the front and rear wall 43, 44 of the furnace may also be provided with secondary air ports 24 therein.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A circulating fluidized bed boiler, comprising:

furnace side walls;

a ceiling;

an air distribution plate provided at a bottom of a furnace; and at least one air distribution cone provided on the air distribution plate, wherein:

each air distribution cone extends upwards from the air distribution plate into an interior of the furnace and has a shape gradually tapered in an extending direction, enclosure side walls which form the air distribution cone are provided with secondary air ports, the enclosure side walls are separated from the furnace side walls, and a furnace combustion space is formed and surrounded by the ceiling, the furnace side walls, the air distribution plate, and the enclosure side walls, wherein a space, which is not a part of the furnace combustion space and is in communication with an external environment of the furnace, is provided below the enclosure side walls, for arranging secondary air pipes therein.

2. The boiler according to claim 1, wherein:

for each air distribution enclosure:

the air distribution enclosure comprises two first inclined enclosure side walls arranged to oppose to each other and two vertical enclosure side walls arranged to oppose to each other;

the two first inclined enclosure side walls are jointed or met at a top end of the air distribution enclosure and are connected with the two vertical enclosure side walls, and an arris line formed by the two jointed or met first inclined enclosure side walls is substantially parallel to the air distribution plate; and the secondary air ports are provided in the two first inclined enclosure side walls respectively.

3. The boiler according to claim 2, wherein:

the enclosure side walls are consisted of membrane walls; and a first header is formed at the arris line so as to be parallel to the air distribution plate, the two first inclined enclosure side walls are collected into the first header, and a first membrane panel extends upwards and vertically from the first header.

4. The boiler according to claim 3, wherein:

the two vertical enclosure side walls extend upwards and vertically to form second membrane panels.

5. The boiler according to claim 2, wherein:

the enclosure side walls are consisted of membrane walls; and the two first inclined enclosure side walls are collected into a tee pipe at the arris line and communicate with two branches of the tee pipe respectively, and a third branch of the tee pipe extends upwards and vertically to form a first membrane panel.

6. The boiler according to claim 2, wherein:

the enclosure side walls are consisted of membrane walls;

the two first inclined enclosure side walls are jointed at the arris line, then extend upwards and vertically and are parallel with each other so as to form a first membrane panel, which is a double-layer panel.

7. The boiler according to claim 4, wherein:

a T-shaped extended heating panel is formed by the first membrane panel and the second membrane panel at an end of the arris line formed by the two jointed or met first inclined enclosure side walls, wherein the first membrane panel composes the vertical of the T shape, while the second membrane panel composes a the horizontal of the T shape, and the first membrane panel and the second membrane panel are welded together by fins.

8. The boiler according to claim 1, wherein:

for each air distribution enclosure:

the air distribution enclosure comprises two first inclined enclosure side walls arranged to oppose to each other and two second inclined enclosure side walls arranged to oppose to each other, the two first inclined enclosure side walls are jointed or met at a top end of the air distribution enclosure and are connected with the two second inclined enclosure side walls, and an arris line formed by the two jointed or met first inclined enclosure side walls is substantially parallel to the air distribution plate; and the secondary air ports are provided in the two first inclined enclosure side walls respectively.

9. The boiler according to claim 8, wherein:

the enclosure side walls are consisted of membrane walls; and the two first inclined enclosure side walls are collected into a tee pipe at the arris line and communicate with two branches of the tee pipe respectively, and a third branch of the tee pipe extends upwards and vertically to form a first membrane panel.

10. The boiler according to claim 8, wherein:

the enclosure side walls are consisted of membrane walls;

the two first inclined enclosure side walls are jointed at the arris line, then extend upwards and vertically and are parallel with each other so as to form a first membrane panel, which is a double-layer panel.

11. The boiler according to claim 9, wherein:

the two second inclined enclosure side walls are jointed with the first inclined enclosure side walls, then extend upwards and vertically and parallel with each other so as to form second membrane panels.

12. The boiler according to claim 11, wherein:

a Y-shaped extended heating panel is formed by the first membrane panel and the second membrane panel at an end of the arris line formed by the two jointed or met first inclined enclosure side walls, wherein the first membrane panel composes the vertical of the Y shape, while the second membrane panel composes a V-shaped portion of the Y shape, and the first membrane panel and the second membrane panel are welded together by fins.

13. The boiler according to claim 1, wherein:

the air distribution cone comprises a lower portion adjacent to the air distribution plate and an upper portion away from the air distribution plate, wherein the lower portion extends upwards and vertically from the air distribution plate, and the upper portion extends upwards to be tapered from a joint with the lower portion.

14. The boiler according to claim 1, wherein:

a section of the air distribution cone parallel to the air distribution plate is formed into an oblong shape or a polygon shape having more than 4 sides.

15. The boiler according to claim 1, wherein:

an arrangement of the air distribution enclosures is symmetrical with respect to a first furnace bisecting section perpendicular to front and rear walls of the furnace.

16. An air distributor for a circulating fluidized bed boiler, the air distributor being provided on an air distribution plate of the boiler, wherein:

the air distributor is in a form of an air distribution enclosure, which extends upwards from the air distribution plate into an interior of a furnace to form a shape gradually tapered in an extending direction, and secondary air ports are formed in air distribution enclosure side walls forming the air distribution enclosure, wherein a space, which is in communication with an external enviornment of the furnace, is provided below the enclosure side walls, for arranging secondary air pipes therein.

17. The air distributor according to claim 16, wherein:

the air distribution cone comprises two inclined enclosure side walls, which are arranged to oppose to each other, and are jointed or met at a top end of the air distribution enclosure to form an arris line which is substantially parallel to the air distribution plate; and secondary air ports are provided in the two inclined enclosure side walls respectively.

18. An air distributor assembly for a circulating fluidized bed boiler, comprising:

the air distributor according to claim 17, wherein the enclosure side walls are consisted of membrane wall; and a membrane panel extending upwards from the air distribution enclosure to form into an expanded heating surface, the membrane panel being in fluid communication with the membrane wall of a respective air distribution enclosure side wall.

* * * * *